US011932958B2

(12) United States Patent
Sheasha et al.

(10) Patent No.: US 11,932,958 B2
(45) Date of Patent: Mar. 19, 2024

(54) ELECTROLYTE FOR CHROMIUM DEPOSITION FROM CR(III)-COMPOUNDS

(71) Applicant: Universitaet Ulm, Ulm (DE)

(72) Inventors: Yasser Sheasha, Ulm (DE); Ludwig Kibler, Hochdorf (DE); Timo Jacob, Neu-Ulm (DE)

(73) Assignee: Universitaet Ulm, Ulm (DE)

( * ) Notice: Subject to any disclaimer, the term of this patent is extended or adjusted under 35 U.S.C. 154(b) by 34 days.

(21) Appl. No.: 17/517,387

(22) Filed: Nov. 2, 2021

(65) Prior Publication Data

US 2022/0127740 A1 Apr. 28, 2022

Related U.S. Application Data

(63) Continuation of application No. PCT/EP2020/061917, filed on Apr. 29, 2020.

(30) Foreign Application Priority Data

May 2, 2019 (EP) ..... 19172413

(51) Int. Cl.
*C25D 3/06* (2006.01)
*C25D 3/10* (2006.01)

(52) U.S. Cl.
CPC ..... *C25D 3/06* (2013.01); *C25D 3/10* (2013.01)

(58) Field of Classification Search
CPC ..... C25D 3/06; C25D 3/10
USPC ..... 205/287, 289, 290
See application file for complete search history.

(56) References Cited

U.S. PATENT DOCUMENTS 630,612 A * 8/1898 Le Banc et al.
2018/0090831 A1 3/2018 Frayer et al.

FOREIGN PATENT DOCUMENTS

JP 2009035806 A * 2/2009 ..... C25D 3/06
WO WO-2015037391 A1 3/2015
WO WO-2017/051001 A1 3/2017

OTHER PUBLICATIONS

Baral et al., "Modeling, Optimization, and Comparative Analysis of Trivalent Chromium Electrodeposition from Aqueous Glycine and Formic Acid Baths," Journal of the Electrochemical Society (Jun. 17, 2005), vol. 152, No. 7, pp. C504-C512. (Year: 2005).*
Choi, "Chromium Base High Performance Materials: Where and How Do They Come From?," Metals and Materials (Aug. 1996), vol. 2, No. 4, pp. 245-252. (Year: 1996).*
(Continued)

*Primary Examiner* — Edna Wong
(74) *Attorney, Agent, or Firm* — MARSHALL, GERSTEIN & BORUN LLP

(57) ABSTRACT

A method for preparing a Cr(III)-plating solution is disclosed. The method comprises or consists of the steps of (a) providing an aged aqueous Cr(III)-solution; (b) adding a polycarbonate or a derivative thereof to the solution of step (a); and (c) adding a borate to the solution of step (b). In addition, a plating solution obtainable by the present method is disclosed, and a plating solution comprising or consisting of Cr(III)-ions, a polycarbonate or a derivative thereof, a borate, water, sulfate, and positive ions selected from the group consisting of hydrogen ions, alkali metal ions and earth alkali metal ions.

12 Claims, 11 Drawing Sheets

(56) References Cited

OTHER PUBLICATIONS

Baral et al., "Modeling, Optimization, and Comparative Analysis of Trivalent Chromium Electrodeposition from Aqueous Glycine and Formic Acid Baths," Journal of the Electrochemical Society 152(7):C504-C512 (2005).
International Search Report and Written Opinion from International Application No. PCT/EP2020/061917 dated Aug. 3, 2020.
Sheasha et al., "Potentiodynamic Chromium Deposition from Trivalent and Hexavelent Systems on Glassy Carbon Electrodes: Initial Stages and Mechanistic Insights," Chemelectrochem 4(6):1390-1394 (2017).

* cited by examiner

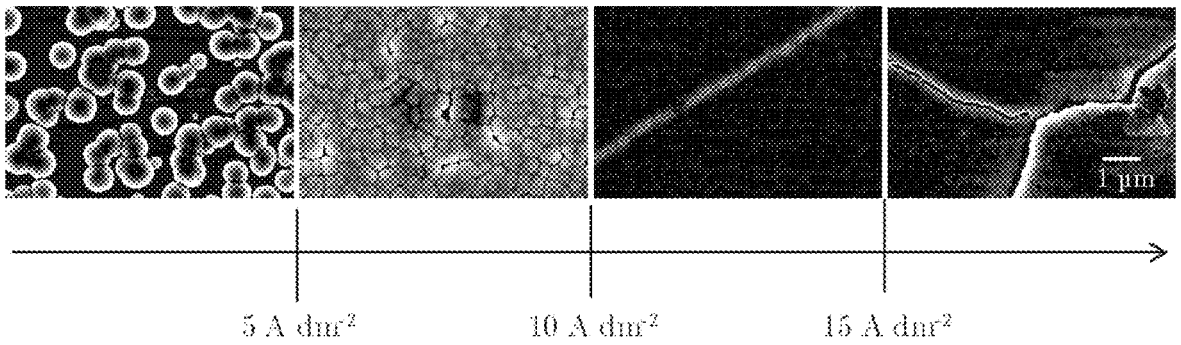
Fig. 13
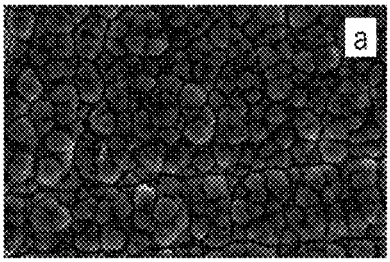
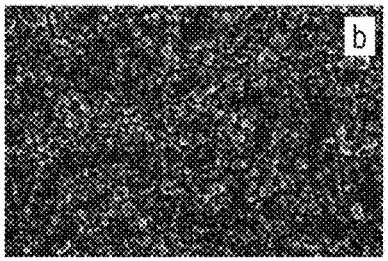
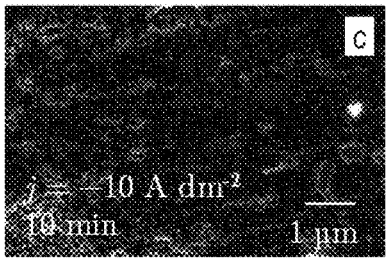
Fig. 14C
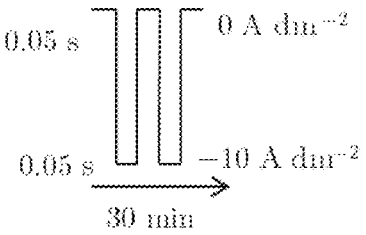
Fig. 14A
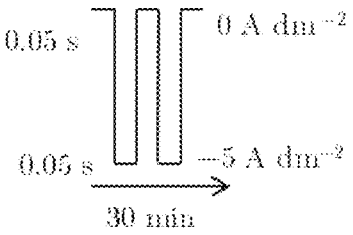
Fig. 14B

ELECTROLYTE FOR CHROMIUM DEPOSITION FROM CR(III)-COMPOUNDS

CROSS-REFERENCE TO RELATED APPLICATIONS

This application is a continuation of copending international patent application PCT/EP2020/061917, filed on 29 Apr. 2020 and designating the U.S., which has been published in English, and claims priority from European patent application EP 19 172 413.7, filed on 2 May 2019. The entire contents of these prior applications are incorporated herein by reference.

FIELD OF THE INVENTION

The present invention pertains to corrosion protection of surfaces with chrome finish, such as metal surfaces of automobiles. In particular, the present invention discloses a method for preparing a Cr(III)-plating solution, comprising or consisting of the steps of (a) providing an aged aqueous Cr(III)-solution; (b) adding a polycarbonate or a derivative thereof to the solution of step (a); and (c) adding a borate to the solution of step (b). Furthermore, the present invention pertains to the plating solution obtainable by the present method, and the plating solution comprising or consisting of Cr(III)-ions, a polycarbonate or a derivative thereof, a borate, water, sulfate, and positive ions selected from the group consisting of hydrogen ions, alkali metal ions and earth alkali metal ions. Furthermore the use of the present plating solution for plating a metal surface or an interface layer between a metal material and at least one further material is disclosed.

BACKGROUND OF THE INVENTION

Corrosion protection of particularly metal surfaces, such as press surfaces, seal surfaces, aluminum surfaces, zinc surfaces or metal alloy surfaces is of utmost importance in different technical fields, such as industries pertaining to construction, automotive, aircraft, aerospace and marine.

RELATED PRIOR ART

Of particular interest and importance is plating with chromium containing solutions. Chrome layers are usually plated from hexavalent chromium solutions, which are the only solutions showing sufficient corrosion resistance. The hexavalent oxidation state of chromium, such as in $CrO_3$, is the most toxic form of chromium. Hexavalent chromium is a known mutagen and carcinogen and recorded as a hazardous air pollutant. Apart from the European Union REACH directive, which classifies hexavalent chromium as hazardous chemical, the EU had adopted the "end of life vehicles directive" wherein hexavalent chromium is identified as one of the hazardous materials used in the manufacture of a vehicle. As such, it is generally banned from use in the manufacture of e.g. vehicles in the states of the EU. There is an increasing demand by industry for alternatives to the use of hexavalent chromium.

Recent alternatives concentrate on trivalent chromium plating offering a rather trouble-free handling of the compound. Chromium plating is for instance disclosed in WO 2017/051001 A1, and US 2018/090831 A1. These known trivalent chromium electrolyte solutions have the drawback that desired properties of the deposited chromium layers are not obtained without adding further additives, such as brighteners, whiteners, levelers, and whiting agents. A further drawback resides in the lack of reproducibility due to continuously changing composition of the plating solution during (unchanged) deposition conditions.

SUMMARY OF THE INVENTION

The objective underlying the present invention resides in overcoming the above-mentioned drawbacks. A further objective resides in the provision of a method for preparing a Cr(III)-plating solution and a Cr(III)-plating solution relying on inexpensive and easily available bulk reagents, particularly reagents available in industrial-scale and corresponding purity. A further objective resides in the provision of a method preparing a Cr(III)-plating solution and a Cr(III)-plating solution having reduced toxicity and which may be easily handled. Still further objectives resides in the provision of method for preparing a Cr(III)-plating solution and a Cr(III)-plating solution which is equally applicable for different types of surfaces, particularly metal surfaces and more particularly interface layers between a metal material and the further material. Another objective of the present invention resides in the provision of a method for preparing a Cr(III)-plating solution and Cr(III)-plating solution which does not require further additives, particularly brighteners, whiteners, levelers, and whiting agents.

The above-mentioned objectives have been solved by providing a method for preparing a Cr(III)-plating solution, comprising or consisting of the steps of:

(a) providing an aged aqueous Cr(III)-solution;
(b) adding a polycarbonate or a derivative thereof to the solution of step (a); and
(c) adding a borate to the solution of step (b).

In addition, a plating solution obtainable by the present method as well as a plating solution comprising or consisting of Cr(III)-ions, a polycarbonate or a derivative thereof, a borate, water, sulfate, and positive ions selected from the group consisting of hydrogen ions, alkali metal ions and earth alkali metal ions is provided. The present invention furthermore provides the use of the present plating solution for plating a metal surface or an interface layer between a material and at least one further material.

In course of the studies leading in the present invention, it has been found that aged aqueous trivalent chromium solution offers the most promising results for consistent deposition. Such an aged solution has usually a blue to violet color due to complexing of trivalent chromium with several water molecules as ligand. Often such aged aqueous Cr(III)-solutions are distinguished from insufficient aged solutions due to a different color, such as greenish chromium sulfate solutions or reddish chromium chloride solutions with low amounts of crystal water. The use of a properly aged aqueous Cr(III)-solution is required for further conversion with a polycarbonate or a derivative thereof followed by a conversion with a borate. Without wishing to be bound by any theory, it is presently assumed that in that case the polycarbonate or a derivative thereof and possibly the borate may act as ligands to the Cr(III)-ion, partially replacing complexed water, such that complexes arise having Cr(III)-ion complexed at the same time with water, polycarbonate or its derivative, and borate. The exact composition of this complex is unknown and it is assumed that it varies with the pH and temperature. It will be appreciated that complexation of Cr(III)-aquo complexes with polycarbonate or a derivative thereof and borate implies that the latter compounds are present in an amount which is approximately equimolar or more to the trivalent chromium species, such as 0.2 moles to 15 moles of ligand per 1 mole of trivalent chromium species.

As already indicated above, an "aged" aqueous Cr(III)-solution as used herein pertains to an aqueous Cr(III)-solution having a blue to violet color. This color is based on at least four water ligands per Cr(III)-ion, or six water ligands. It will be appreciated, however, that trivalent chromium salts exist, wherein the complexation degree with water may be not readily followed by the color. Such trivalent chromium salts are also encompassed by the present invention.

The trivalent chromium salt may be for instance chromium sulfate, chromium hydroxide sulfate, chromium chloride, or chromium nitrate. Preferably, chromium sulfate or chromium hydroxide sulfate is employed.

A "polycarbonate" as used herein pertains to a compound having at least two residues selected from the group of a carboxylate and a salt of a carboxamide for complexation to a trivalent chromium ion. The polycarbonate is present as polycarbonate salt, i.e. with counter ions, such as protons. Examples of preferred polycarbonates encompass malic acid, oxalic acid, malonic acid, succinic acid, glutaric acid and adipic acid, and the salts thereof. Preferably, the polycarbonate is of technical grade. The polycarbonate may also exhibit functional groups such as a hydroxyl group, amine groups, etc. attached to the C-backbone. For instance, malic acid exhibits a single hydroxyl group at the C-backbone.

A "derivative" of a polycarbonate as used herein is directed to a polymer having at least two functional groups for complexing trivalent chromium species, wherein the functional groups are selected from the group consisting of a carboxylic acid, an amide, or a salt thereof. Hence, a "derivative" of a dicarbonate encompasses a molecule having two amide residues or a molecule having one amide residue and one carboxylate residue.

In general, a suitable polycarbonate or a derivative thereof may have a molecular weight of from 90 g/mol to 350 g/mol, such as 90 to 200 g/mol, 90 to 150 g/mol, or 90 to 126 g/mol. For instance, the molecular weight of water-free oxalic acid is 90 g/mol, and the molecular weight of oxalic acid dihydrate is 126 g/mol.

A "borate" as used herein pertains to any borate ion of a borate compound, or boric acid. Preferred examples of borates include borax and/or boric acid. Preferably, the borate is of technical grade.

The present method may be conducted at various pH values. In general, however, usually a low pH of 2.5 is employed for steps (a), (b), and (c), such that the polycarbonate(s) or the derivative(s) thereof as well as the borate(s) are usually present in form of their corresponding acids. It is well within the knowledge of the skilled person determining an optimal pH range for each method step on the basis of the employed trivalent chromium compound and the other reagents.

The low pH of 2.5 furthermore has usually the effect that excessive amounts of the acid in comparison to the amounts of other reagents are employed. The anion of the acid may also serve as a ligand of the trivalent chromium species.

The above pH values are preferably adjusted with concentrated sulfuric acid. Usually, step (a) is conducted at the lowest pH value, possibly requiring adjusting a higher pH for steps (b) and (c). Adjusting a higher pH may be performed with any inorganic base, preferably a hydroxide salt of an alkali metal or a hydroxide salt of an earth alkali metal, including for instance sodium hydroxide, potassium hydroxide, magnesium hydroxide, and calcium hydroxide. Sodium hydroxide is particularly preferred.

The term "concentrated" sulfuric acid pertains to at least 30% sulfuric acid, such as at least 50% sulfuric acid, at least 75% sulfuric acid, at least 90% sulfuric acid, at least 95% sulfuric acid, or at least 98% sulfuric acid. The concentrated sulfuric acid may be also present in form of oleum or fuming sulfuric acid, i.e. sulfuric acid having sulfur trioxide dissolved therein. Preferably, the concentrated sulfuric acid is of technical grade.

It will be readily understood by the skilled person that the individual reagents are all present as salt or acid, i.e. that respective counter ions are present even though not expressively stated. In that case, types of suitable counter ion(s) are known to the skilled person. For instance, the skilled person is well aware that a "Cr(III)-species" refers to a Cr(III)-salt, such as chromium sulfate.

Hence it will be appreciated that the plating solution comprising or consisting of Cr(III)-ions, a polycarbonate or a derivative thereof, a borate, water, sulfate, positive ions selected from the group consisting of hydrogen ions, alkali metal ions and earth alkali metal ions and optionally negative ions selected from the group consisting of fluoride, chloride, bromide, iodide, and nitrate encompasses a charged balance. The skilled person is well aware about this issue.

According to an embodiment of the present invention a pH 2.5, preferably 2.3, more preferably between 0 and 2.3, applies for steps (a), (b), and (c).

According to another preferred embodiment of the present invention the aged aqueous Cr(III)-solution is provided by dissolving a Cr(III)-salt in concentrated sulfuric acid, adding water, and heating to a temperature of 70 to 130° C. for at least one hour.

The Cr(III)-salt may be for instance chromium sulfate, chromium hydroxide sulfate, chromium chloride, or chromium nitrate. Preferably the concentrated sulfuric acid is concentrated to such a degree and/or used in an amount such that the pH of the aged aqueous Cr(III)-solution has a pH of −0.1 to 0.5, preferably −0.05 to 0.1, more preferably −0.02 to 0.02. A preferred temperature is 75 to 115° C., such as 80 to 120° C., 90 to 110° C., 95 to 105° C., or 100° C. Heating is furthermore performed for at least one hour, such as at least two hours, or at least three hours. In general, a lower temperature requires a longer heating period.

According to another preferred embodiment of the present invention the aged aqueous Cr(III)-salt is chromium sulfate or chromium hydroxide sulfate.

These compounds are advantageous in view of their availability in high amounts, in particular in technical grade.

According to still another preferred embodiment of the present invention the present method further comprises after step (b), step (b1) of heating the solution to a temperature of 50 to 80° C. for 0.5 to 3.0 hours and/or step (b2) of adjusting a pH of 0.7 to 1.3.

A preferred temperature of step (b1) is 55 to 75° C., such as 60 to 70° C., or 65° C. Heating is furthermore performed for 0.5 to 3.0 hours, such as 1.0 to 2.5 hours, or 1.5 to 2.0 hours. In general, a lower temperature requires a longer heating period.

Step (b2) of adjusting a pH of 0.7 to 1.3, such as 0.8 to 1.2, 0.9 to 1.1, or about 1.0, is performed by adding one of the above mentioned inorganic bases, preferably sodium hydroxide.

According to another embodiment of the present invention the present method further comprises after step (c), step (c1) of heating the solution of step (c) to a temperature of 50 to 80° C. for 0.5 to 3.0 hours and/or step (c2) of adjusting a pH of 1.7 to 2.3.

A preferred temperature of step (c1) is 55 to 75° C., such as 60 to 70° C., or 65° C. Heating is furthermore performed for 0.5 to 3.0 hours, such as 1.0 to 2.5 hours, or 1.5 to 2.0 hours. In general, a lower temperature requires a longer heating period.

Step (c2) of adjusting a pH of 1.7 to 2.3, such as 1.8 to 2.2, 1.9 to 2.1, or about 2.0, is performed by adding one of the above mentioned inorganic bases, preferably sodium hydroxide.

According to another preferred embodiment of the present invention the polycarbonate or the derivative thereof is selected from the group consisting of a dicarbonic acid and a tricarbonic acid.

Exemplary dicarbonic acids are the same as indicated above. Exemplary tricarbonic acids comprise 1,2,3-propantricarbonic acid or 1,2,3-benzenetricarbonic acid. Oxalic acid and/or malic acid are preferred. Particularly preferred is oxalic acid.

According to still another embodiment of the present invention the borate is borax and/or borate acid.

According to another embodiment of the present invention, an additive selected from the group consisting of a brightener, a whitener, a leveler, and a whiting agent, such as an alkali metal halide, is not included.

It is particularly preferred that no further additive is comprised.

According to still another preferred embodiment of the present invention a molar ratio of Cr(III)-ion:polycarbonate or a derivative thereof:borate is 1.0:0.50 to 0.95:2.0 to 9.0.

Preferably the before-mentioned ratio is 1.0:0.8 to 0.9:5.0 to 6.0, more preferably 1.0:0.83 to 0.84:5.33 to 5.34.

More preferably, the polycarbonate or a derivative thereof is oxalic acid or malic acid. Alternatively or in addition, the borate may be boric acid. Advantageously, chromium sulfate and/or chromium hydroxide sulfate are employed.

According to still another preferred embodiment of the present invention a molar ratio of Cr(III)-ion:polycarbonate or a derivative thereof:borate:sulfuric acid is 1.0:0.50 to 0.95:2.0 to 9.0:4.0 to 10.0.

Preferably the before-mentioned ratio is 1.0:0.8 to 0.9:5.0 to 6.0:6.0 to 7.0, more preferably 1.0:0.83 to 0.84:5.33 to 5.34:6.60 to 6.80.

More preferably, the polycarbonate or a derivative thereof is oxalic acid or malic acid. Alternatively or in addition, the borate may be boric acid. Alternatively or in addition, the sulfuric acid has a concentration of at least 90%. Advantageously, chromium sulfate and/or chromium hydroxide sulfate are employed.

More preferably, the compounds in the amounts of FIG. 4 are employed, i.e. about 0.15 mol/d of a trivalent chromium species, about 0.125 mol/d oxalic acid dihydrate, and about 0.8 mol/d $H_3BO$, in concentrated sulfuric acid.

The present plating solution may be used for any type of surface, such as metal, plastic and glass surfaces, or portions thereof. The present plating solution is advantageously used in the field of construction, automotive, aircraft, aerospace or marine.

The present plating solution is particularly suitable for plating an interface layer between a metal material and at least one further material. The at least one further material is preferably a material which is different from that of the metal material. The at least one further material may be for instance a metal, such as an alloy, different from the metal material. Other examples of the at least one further material encompass glass and plastic.

In the context of the present invention, the expression "essentially consists of" or "essentially consisting of" designates a partially closed enumeration and designates methods or preparations which apart from the named components only have such further components which do not materially alter the character of the method or preparation according to the invention.

When in the context of the present invention a method or preparation is described with the use of the expression "have" or "having" or 'comprise" or "comprising" or similar expressions, this expressly includes method or preparations which consist of said components or essentially consist of said components.

These and other aspects of the invention will be apparent from and elucidated with reference to the embodiments described hereinafter.

BRIEF DESCRIPTION OF THE DRAWINGS

FIG. 6A shows time dependent UV-VIS absorption spectra of the first preparation step (0 min., 60 min., 90 min., 180 min., 240 min. and 300 min.), and FIG. 6B the change in peak positions during heating as a function of time.

FIG. 13 shows SEM images of Hull Cell sample highlighting the microstructure in different current density regions.

FIGS. 14A and 14B show SEM images and galvanic pulsing deposition diagram of Chromium deposited on brass at $I_L$=10 A $dm^{-2}$ and $I_L$=10 A $dm^{-2}$, respectively. FIG. 14C shows a SEM image of galvanostatically deposited chromium on brass at j=−10 A $dm^{-2}$ for 10 minutes.

FIG. 19 shows an illustration for a possible mechanism for chromium deposition from a solution prepared according to the present method.

FIG. 20 shows a SEM image of a chromium deposit from a formic acid complexed solution.

DESCRIPTION OF PREFERRED EMBODIMENTS

Example 1: Electrochemical Measurements with Aged Solutions

Figure 1A:
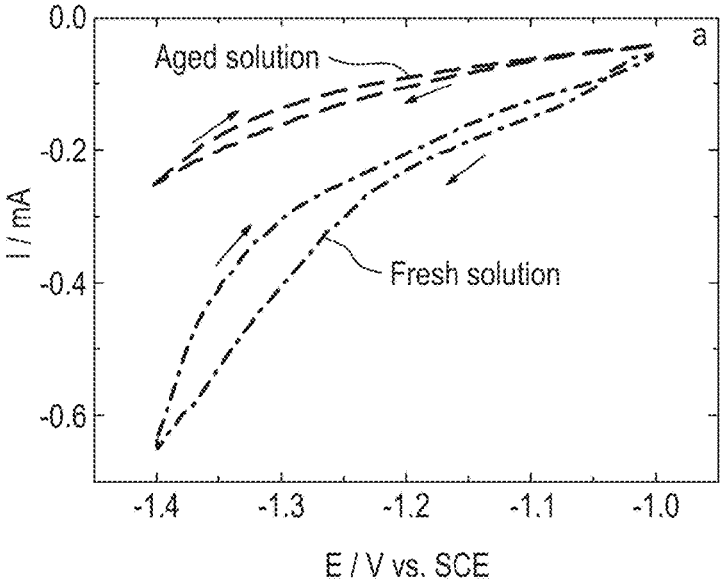
FIG. 1A shows current-potential curves for the potentiodynamic deposition of chromium on a glassy carbon (GC) electrode from different aged solutions.

In general, hydrogen evolution on the surface should be minimized for depositing films. Hence, the pH was increased to a value of 3, which is a common value for chromium film deposition from trivalent solutions, by decreasing the concentration of $H_2SO_4$. In order to compensate for the change in conductivity and sulfate concentration 0.1 M $Na_2SO_4$ was added to the green solution. The pH of the aged blue solution was adjusted using NaOH. The current-potential curves at 15 minutes of deposition as well as scanning electrode microscope (SEM) images of both systems after a total cycling time of 2 hours are shown in FIG. 1.

In said figure, FIG. 1 (*a*) shows current-potential curves for the potentiodynamic deposition of chromium on GC from a fresh solution and an aged solution (b) and (c) represent SEM images of the deposits ((b) fresh solution and (c) aged solution), respectively. General conditions: pH 3, 15 min., 50 mV $s^{-1}$. Fresh solution: 0.01 mM $H_2SO_4$+10 mM $Cr_2(SO_4)_3$+0.1 M $Na_2SO_4$. Aged solution: 0.1 M $H_2SO_4$+10 mM $Cr_2(SO_4)_3$+NaOH.

Figure 1B:
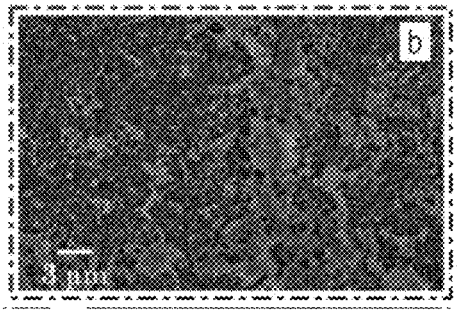
FIGS. 1B and 1C show SEM images.
Figure 1C:
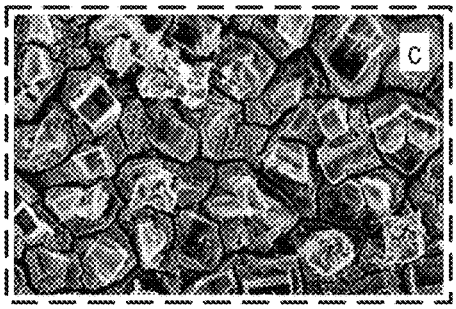

It is apparent from both the voltammograms as well as the SEM images that the nature of the present chromium(II) species plays a huge role on the quality of the deposit. The deposit from the fresh solution in FIG. 1*b* is amorphous, while that from the aged solution (FIG. 1*c*) is crystalline, which is also evident from the apparent growth of an incomplete layer on top of the deposit in both cases. Even though by increasing the pH, the hydrogen evolution reaction (HER) activity is decreasing, however the currents measured are mainly HER currents. Nonetheless, it can be seen from FIG. 1*a* that the HER currents for the aged solution are almost half of that measured for the fresh solution, highlighting a possibly more efficient deposition.

Additionally, since electrodeposition is commonly done with a fixed potential/current, potentiostatic measurements on both systems were carried out. Upon systematic investigations, it was found that at −1.3 V vs. a saturated calomel electrode (SCE), potentiostatic deposition is successful on GC. Hence, FIG. 4.15 shows the current transients as well as SEM images for potentiostatic measurements on fresh and aged solutions, at a pH of 3, for 2 hours, at E=−1.3 V.

From FIG. 2 (*a*) current-time curves for the potentiostatic deposition of chromium on GC from a fresh solution and an aged solution may be derived. FIGS. 2 (*b*) and (*c*) represent SEM images of the deposits ((b) fresh solution and (c) aged solution), respectively, may be derived. General conditions: pH 3, E=1.30 V vs. SCE, 2 h. Fresh solution: 0.01 mM $H_2SO_4$+10 mM $Cr_2(SO_4)_3$+0.1 M $Na_2SO_4$. Aged solution: 0.1 M $H_2SO_4$+10 mM $Cr_2(SO_4)_3$+NaOH.

Figure 2A:
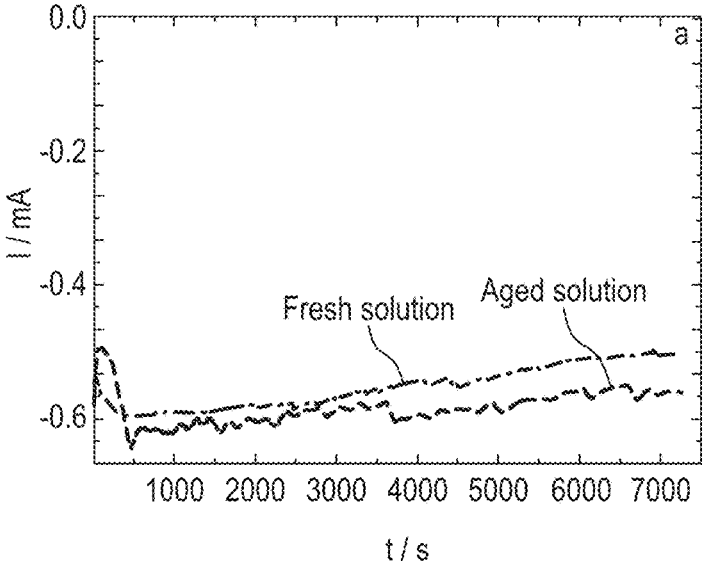
FIG. 2A shows current-time curves for the potentiostatic deposition of chromium on a GC electrode from different aged solutions.
Figure 2B:
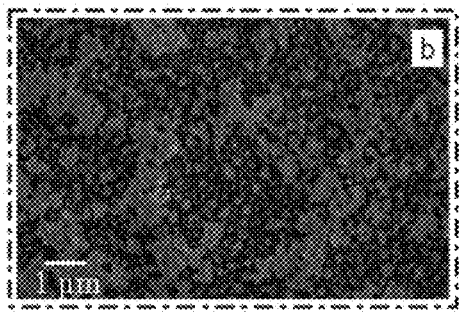
FIGS. 2B and 2C show SEM images.
Figure 2C:
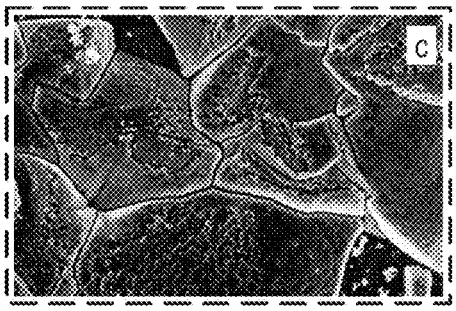

While the current transients in FIG. 2*a* show a similar behavior, the SEM images in FIGS. 2*b* and 2*c* are different from one another. It is evident that the structure of the deposit from the aged solution consists of large crystalline grains, where a layer-by-layer growth takes place, as seen from the morphology of the crystallites, while that from the fresh solution gives rise to an amorphous film.

Example 2, Thermal Acceleration and Up-Scaling

Even though the aged system seemed very promising, the extremely long ageing time represents a drawback. Thus, the next step was to try and accelerate this process by heating. By heating a solution of 0.1 M $H_2SO_4$+10 mM $Cr_2(SO_4)_3$ for three hours at 100° C., the solution color changed from green to blue. If the pH is then adjusted to 3 by addition of NaOH, similar to the aged solutions, the resulting deposits are similar to those in FIG. 1*c*. Hence, this technique was successful to accelerate the formation of the monomeric hexaquo-complexes.

After successfully producing the blue solutions, the next step was to verify if this technique is also possible with higher concentrations. The low chromium(II) concentrations used so far, though ideal to understand the behavior of the system, need to be increased to be comparable to other studies/systems. In addition, boric acid, $H_3BO_3$, was added to the solution. Even though it seems that the boric acid does not affect the deposition on GC, however since deposition on metal surfaces, which will be discussed later on, does not happen except in its presence.

Figures 3A, 3B, 3C:
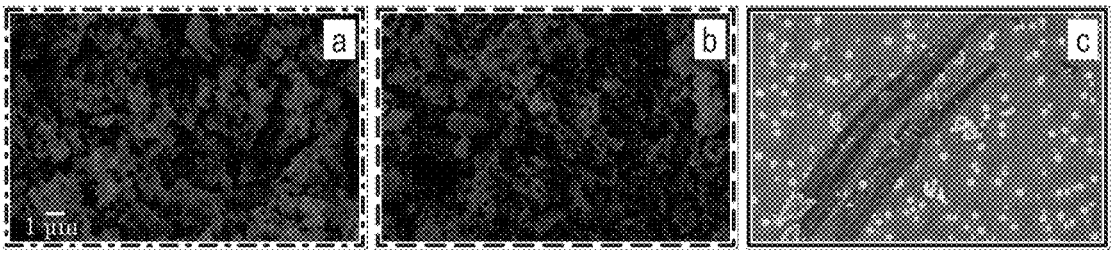
FIG. 3A shows SEM images of galvanostatically deposited chromium on GC from a fresh Cr(III) solution.
FIG. 3B shows SEM images of galvanostatically deposited chromium on GC from an aged Cr(III) solution.
FIG. 3C shows SEM images of galvanostatically deposited chromium on GC from a fresh Cr(III) solution complexed with malic acid.

Therefore, the chromium concentration was increased to 0.15 mol $L^{-1}$ (10 g/L of $Cr^{3+}$). In addition, 0.81 mol $L^{-1}$ (50 g/L) of boric acid were added after the preparation of the blue solution, and before adjusting the pH to 3.7. Measurements were also performed with a fresh (green) solution of the same concentration and components. Galvanostatic measurements were carried out in both solutions, with a cathodic current density j=5 A $dm^{-2}$ for 15 minutes. FIG. 3*a* shows the structure of the deposit from the fresh solution, while FIG. 3*b* shows that from the blue solution. In particular, FIG. 3 shows SEM images of galvanostatically deposited chromium on GC from (a) a fresh Cr(III) solution, (b) an aged Cr(III) solution (c) a fresh Cr(III) solution complexed with malic acid.

The SEM images are similar, and in both cases chromium hydroxide precipitates were found on the surface. Unlike metallic chromium, this is a light green rough powder, which is responsible for the porous structure seen in FIGS. 3*a* and 3*b*. The formation of the hydroxide is primarily due to the high pH of the solution and the even higher pH at the surface during deposition, which causes olation of the chromium species, and their precipitation as chromium hydroxide. However, underneath these hydroxide precipitates, a thick chromium layer could be seen with the deposit from the blue solution, in contrast to that of the green solution.

To prevent olation and subsequent formation of hydroxides, organic complexing agents are commonly used. In order to demonstrate this effect a fresh solution was complexed with 0.127 mol $L^{-1}$ (17 g/L) of malic acid, by heating the mixture at 65° C. for 90 minutes before deposition. This resulted in a color change from green to violet, indicating a successful complexation with malic acid. The result of the deposition is seen in FIG. 3*c*, where the porous structures are no longer visible, however the quality of the deposit itself is rather poor, with different coloration of the film and an inconsistent deposit. This is because the introduction of malic acid to the green solution means the complexation of the pre-existing poly-nuclear chromium molecules, which are themselves difficult to reduce, even if further olation is prevented by complexation with malic acid.

Therefore, in order to develop a new system combining the deposition readiness of the blue solution and the elimination of hydroxides by organic complexation, the chromium hexaquo-complex monomers need to be further complexed with an organic complexing agent, to combine the advantages of both systems.

Example 3, Designing the New Solution

Figure 4:
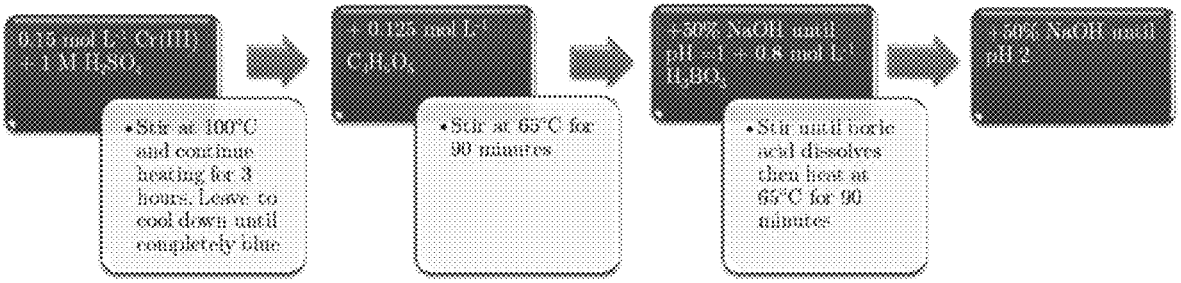
FIG. 4 schematically shows a method for preparing a Cr(III)-plating solution according to the present invention.

Taking all this into consideration, the composition of the new system would be as follows: 1 M $H_2SO_4$+0.15 M $Cr^{3+}$+0.125 M $C_4H_6O_5$+0.8 M $H_3BO_3$+NaOH. The components are mixed together as shown in FIG. 4.

The increase in concentration of $H_2SO_4$ may serves many purposes. During the first stage, the pH is lowered to 0, and thus the formation of hexaquo-complex monomer by heating at 100° C. occurs more readily. It also increases the bath conductivity, so that no extra conducting salts need to be added, thus keeping the system as simple as possible. Moreover, it acts as a very good pH buffer in the optimum bath operating pH of between 1.7 and 2. This has the further effect that no additional buffering agent is required.

The amount of chromium is described as 0.15 M $Cr^{3+}$, because two different chromium(II) salts were investigated, $Cr_2(SO_4)_3$ and $Cr(OH)(SO_4)$, the latter, basic chromium sulfate, being investigated due to its popularity in the research and industrial fields as a chromium salt for galvanic purposes. For the sake of the UV-VIS study, the solutions were prepared with the basic chromium sulfate. However, the behavior is identical for chromium(II) sulfate.

Figure 5:
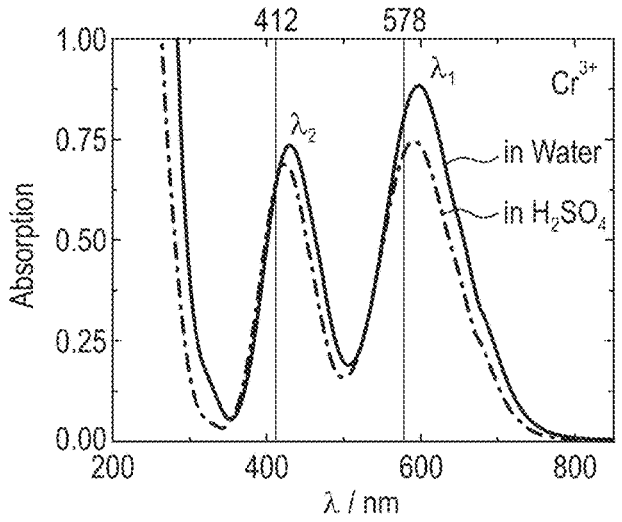
FIG. 5 shows UV-VIS absorption spectra of basic chromium sulfate dissolved in water and sulfuric acid.

Before discussing the changes in the nature of chromium complexes due to the aforementioned preparation technique, the spectra of $Cr(OH)(SO_4)$ in 1 M $H_2SO_4$ and in water were compared to see if there already a difference is to be noticed, even though to the eye both solutions have a deep green color. The spectra are shown in FIG. 5. In particular, FIG. 5 shows UV-VIS absorption spectra of basic chromium sulfate dissolved in water and sulfuric acid.

In the spectra of the two solutions, however, differences are quite evident. The smaller wavelengths for the recognizable d-d transitions ($\lambda_1$ and $\lambda_2$) in an acidic environment signal a reduction in ligand field splitting. This can be attributed to the fact that in 1 M $H_2SO_4$, the pre-existing hydroxide ligand in the $Cr(OH)(SO_4)$ salt is converted by protonation into a water ligand or exchanged for a water molecule. Since water splits the octahedral field more strongly than hydroxide, the absorption shifts to higher excitation energies and thus to shorter wavelengths. In addition, the lowering of the pH affects the environment of the complex; chromium complexes tend to oligomerize at higher pH values. Therefore, acidification shifts the equilibrium very much towards the monomer, supporting the earlier hypothesis that a slow ligand exchange reaction to finally obtain monomers of the hexaquo-complex occurs. Since monomeric chromium complexes require higher excitation energies than dimers, trimers, and oligomers, this process enhances the shift of absorption bands to smaller wavelengths. This also supported by the observation that the peaks shift towards the vertical lines, which are the peak positions of the $[Cr(H_2O)_6]^{3+}$ monomer. In this respect, FIG. 6 shows the change in the UV-VIS spectra during the first preparation step (step (a)). FIG. 6(*a*) shows time dependent UV-VIS absorption spectra of the first preparation step (0 min., 60 min., 90 min., 180 min., 240 min. and 300 min.), and FIG. 6(*b*) the change in peak positions during heating as a function of time.

Figure 6A:
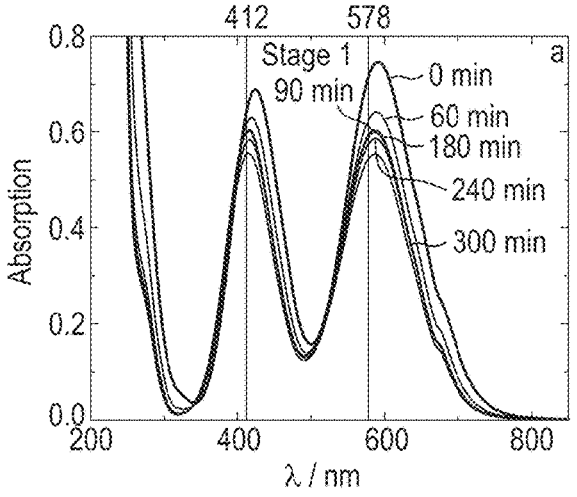
FIGS. 6A and 6B show the change in the UV-VIS spectra during the first preparation step (step (a)).
Figure 6B:
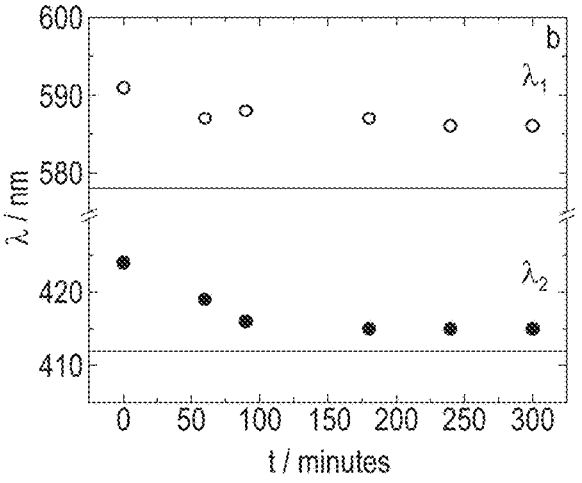

FIG. 6*a* shows spectra taken at various intervals while the solution is being heated at 100° C. In FIG. 6*b*, the peak positions are plotted vs. heating time, in order to determine how long it is required to heat the solution before reaching equilibrium. Based on these measurements, a heating time of at least 3 hours is required to achieve monomeric hexaquo-complex ions ($\lambda_1$ and $\lambda_2$).

Both the shift to higher excitation energies and the blue coloration of the solution strongly suggest an exchange of sulfate with water in the chromium complex. It has been reported that an aquo ligand causes greater ligand field splitting than a sulfate ligand, and the observed color change for this ligand exchange, along with the shift in the maximum transmission wavelength between $\lambda_1$ and $\lambda_2$ to lower values, has also been reported.

The ligand exchange reaction is a reversible reaction, which is why the concentration ratio of aquo-complex to sulfate complex depends mainly on the concentration of sulfate in solution:

$$[Cr(H_2O)_5(SO_4)]^+_{(aq)}+H_2O_{(l)} \rightleftharpoons [Cr(H_2O)_6]^{3+}_{(aq)}+SO_4^{2-}{}_{(aq)}.$$

Figure 7A:
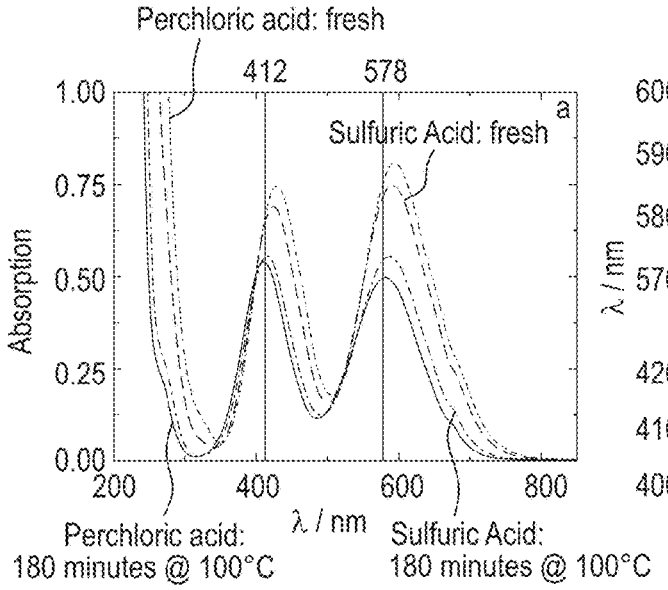
FIGS. 7A and 7B show UV-VIS absorption spectra before and after the first preparation step for sulfuric acid and perchloric acid as solvents, respectively.
Figure 7B:
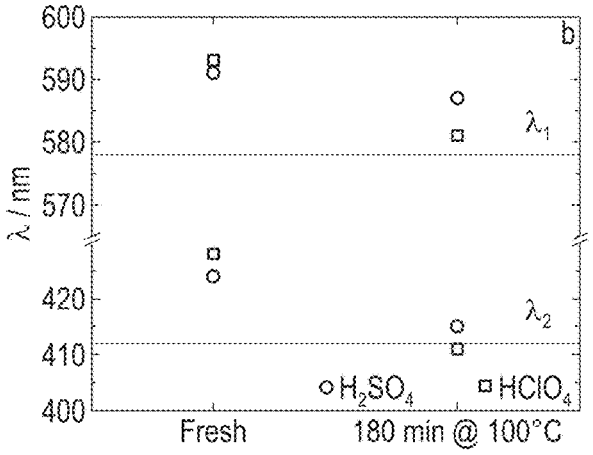

In order to verify this, an identical solution was prepared, with 1 M perchloric acid, $HClO_4$, where a stronger shift towards the wavelength values of the hexaquo complex monomers after stage 1 would be expected. The differences between both sulfuric acid and perchloric acid systems are highlighted in FIG. 7. FIG. 7 (*a*) shows differences in UV-VIS absorption spectra before and after the first preparation step for sulfuric acid and perchloric acid as solvents. FIG. 7(*b*) indicates peak shifts for both systems.

The graphs show that in comparison to the sulfuric acid system, the peaks move closer to the literature values reported for the hexaquo-complex. The much lower sulfate concentration means that the majority of species in solution is the hexaquo-complex, which would be expected to form due to heating at high temperatures, which allows water ligands to replace strongly bound ligands.

After obtaining the blue colored solution, consisting primarily of $[Cr(H_2O)_6]3+$, the next step is to further complex the monomers with malic acid. Hence, the malic acid is added to the solution, which is then heated to 65° C. for 90 minutes, to ensure thorough mixing. Even though at the very low pH of 0, it would not be expected that the malic acid dissociates and further complexes the chromium, its presence at such an early stage ensures that along the preparation no olation reactions take place. This was verified by preparing the solution without heating after the addition of malic acid, which lead to similar deposition results.

The addition of NaOH up to adjust the pH to 1 also has very little effect on the UV-VIS spectrum. Only the charge-transfer transition shifts toward longer wavelengths, completely covering the third d-d transition, which is seen in FIG. 7*a* as a shoulder at around 300 nm. However, after the boric acid was added, and the solution was heated again for 90 minutes at 65° C., the spectrum clearly changes. The intensity ratio between both peaks is reversed, with a greater increase in the absorption band at $\lambda_1$ than at $\lambda_2$ (marked by (1) and (2), respectively). At the same time, $\lambda_1$ shifts to a smaller wavelength, and $\lambda_2$ to a longer one. This indicates complexation with malic acid. Since malate is a much better ligand than malic acid itself, deprotonation of malic acid is necessary for ligand exchange:

$$C_4H_6O_{5(aq)} \rightleftharpoons C_4H_5O^-_{5(aq)} + H^+_{(aq)}.$$

With a pKa value of 3.4, the equilibrium at pH 1 is strongly shifted towards the acid. Therefore, the complexation takes place rather to a small extent, especially since the ligand exchange is thermodynamically favored but kinetically hindered:

$$[Cr(H_2O)_6]^{3+}_{(aq)} + C_4H_5O^-_{5(aq)} \rightleftharpoons [Cr(C_4H_5O_5)(H_2O)_5]^{2+}_{(aq)} + H_2O_{(l)}.$$

Figure 8A:
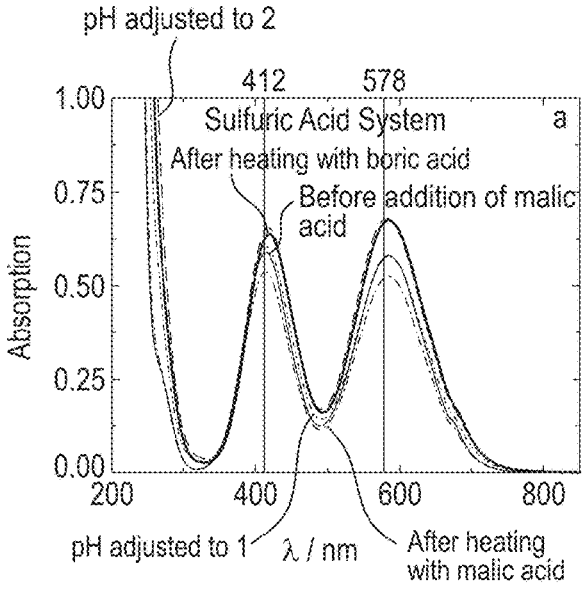
FIGS. 8A and 8B show UV-VIS absorption spectra for the remaining preparation steps in sulfuric acid and perchloric acid, respectively.

Heating allows overcoming of the activation barrier, and hence the ligand exchange process is more likely to occur, which is confirmed by the change in the UV-VIS spectra for both sulfuric and perchloric acid systems, as seen in FIG. 8. In particular, FIG. 8 shows UV-VIS absorption spectra for the remaining preparation steps in (a) sulfuric acid and (b) perchloric acid.

The presence of boric acid, however, has no effect on the formation of the chromium complex, as comparison spectra for heating without boric acid show. The effect of boric acid on metal deposition is usually attributed to buffering of the solution. However, this is unlikely to be the case, since boric acid has a pKa value of 9.27, and thus has no buffering capacity in the pH region used. Nonetheless, the presence of boric acid is essential not only for chromium deposition, but also for many other transition metals.

Figure 8B:
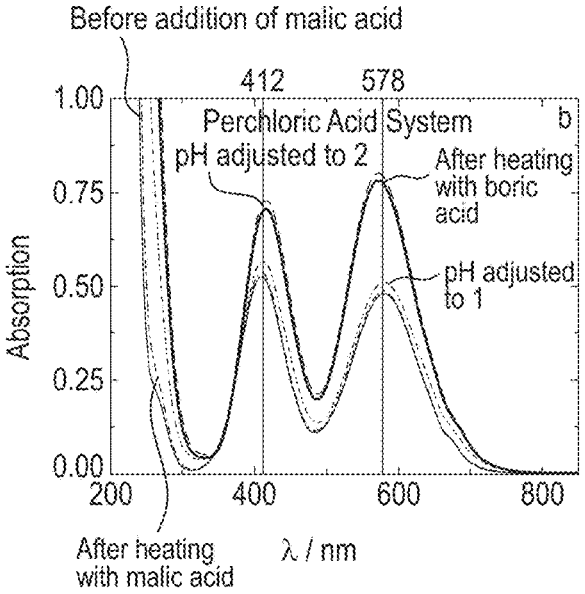

In comparison to the sulfuric acid system, only a few differences in the spectroscopy of the perchloric acid system in FIG. 8*b*, indicating that the sulfate concentration has negligible influence on the resulting complex in solution after the preparation is complete.

Starting from already lower values for $\lambda_1$ and $\lambda_2$ (marked by (1) and (2)), the shifts are smaller than those of the sulfuric acid system. This can be due to the lower proportion of complexes containing sulfate or hydrogen sulfate as a ligand in the perchloric acid system, which does not change much as the preparation continues. The increase in absorption after heating with boric acid is much larger than that of the sulfuric acid system in FIG. 8*a*. The lower sulfate concentration therefore appears to increase the probability of transition upon excitation.

The kinetic stability of the aquo-complex also explains why upon increasing the pH to 2, no spontaneous change in the spectrum despite the equilibrium shift in the malic acid-malate system. However, after an ageing time of one day, a decrease in the wavelength of the first d-d transition occurs, while the wavelength of the second transition remains nearly constant. In addition, the absorption values steadily increase. This indicates a continuously increasing concentration of malate-complexed chromium. The very small shift in wavelength is attributed to the similarity in ligand-field splitting between carboxylates and water. In literature, this behavior is mostly documented only for oxalate, but malate as a dicarboxylic acid anion should show similar spectrochemical properties.

Electrochemical deposition carried out directly after pH adjustment show a chromium hydroxide precipitates on top of a deposited chromium film. Upon ageing the solution for a few days, this effect disappears. Hence, this provides further evidence that a slow ligand exchange process takes place after the final pH adjustment.

To accelerate the ligand exchange process, the solution was heated to 50° C. After two and a half hours at this temperature, a significant increase in absorption is evident, especially at $\lambda_1$, which continues systematically. The solution changes its color from dark blue to intense violet. Heating at 50° C. at a pH of 2 thus proves to be a good way to effect a clear ligand exchange. However, the acceleration of the ligand exchange cannot be achieved by very high temperatures. For example, when the solution is heated to 100° C., the electrolyte loses the violet tint and returns to the blue color of the aquo-complex.

Since the deprotonation of the second acid group of the 2-hydroxybutanedioic acid (malic acid) has a pKa of 5.11, it should occur only at significantly higher pH values than the present one. Hence, the malate should act as a single negatively charged ligand. Thus, a bridging of two chromium centers by a malate ligand with two complexing carboxyl groups is unlikely. This is consistent with the theoretical calculations, where it was found that monodental coordination of the oxalate ligand for a chromium (III) pentaqua-oxalate complex occurs at a pH of 3.

Figure 9A:
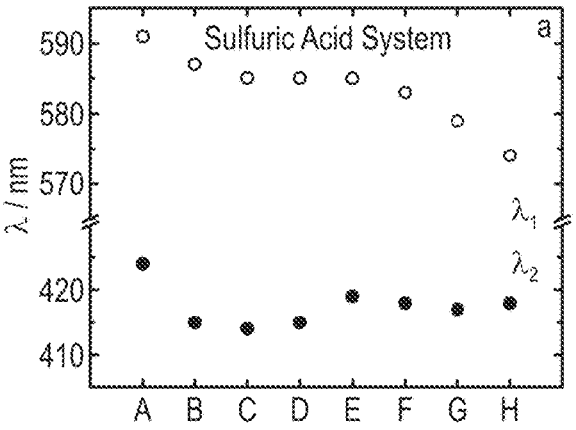
FIGS. 9A and 9B show changes in UV-VIS absorption peaks for sulfuric acid system and perchloric acid system, respectively.
Figure 9B:
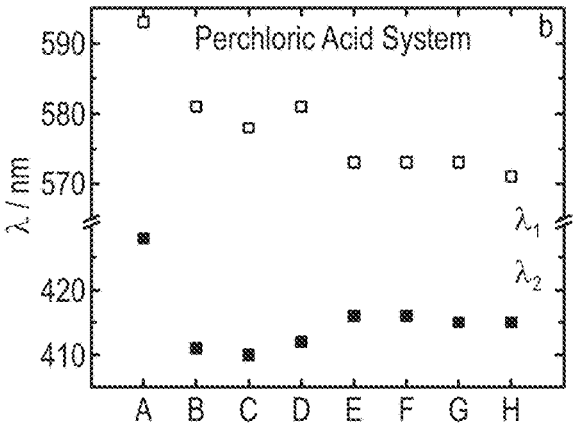

In summary, Table 1 lists the relevant steps for preparing monomericly complexed chromium species. FIGS. 9*a* and *b* show the changes in $\lambda_1$ and $\lambda_2$ for the sulfuric and perchloric acid systems along the course of preparation, respectively. In principle, the spectroscopic behavior of the complex in both media is very similar; with the absorption maxima in perchloric acid in comparison to sulfuric acid shifted by a few nanometers to lower wavelengths.

TABLE 1

Summary of preparation stages and details of each stage:

| Stage | Preparation Details |
|---|---|
| A | Fresh Solution |
| B | Heating at 100° C. for 180 minutes |
| C | Heating with malic acid at 65° C. for 90 minutes |
| D | pH adjustment to 1 |
| E | Heating with boric acid at 65° C. for 90 minutes |
| F | pH adjustment to 2 |
| G | Ageing for 1 day at room temperature |
| H | Ageing at 50° C. for 120 minutes |

However, these spectroscopic studies can not conclusively clarify whether the sulfate present in the solution influences the complexation or even acts as a ligand in the active Cr(III) complex. The presence of a sulfate or hydrogen sulfate ligand is evidenced by the difference in peak wavelengths between the complexes in the perchloric acid system and the sulfuric acid system. The spectra of the sulfuric acid system show the absorption maxima at higher wavelengths; which indicates the coordination of a spectrochemically weak ligand such as sulfate. However, the difference of 3 nm between both systems after aging is very small.

Example 4, Electrochemical Deposition from the Monomeric Complex

Electrochemical deposition measurements were carried out from the newly designed solution, not only to assess the performance of the system, but also as verification that indeed a new species is present in solution, and that the nature of the present species is critical for electrodeposition. While over 1000 measurements were performed to aid in preparation and to understand the system, representative measurements are shown hereinafter to highlight the plating properties of the new bath.

Example 4.1, Electrodeposition on GC

Figure 10A:
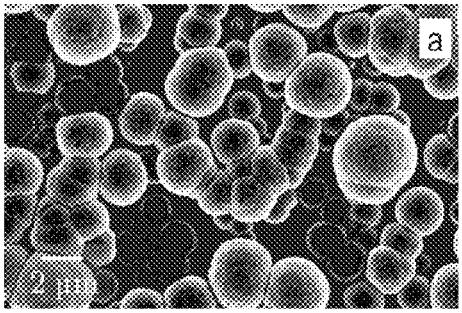
FIGS. 10A and 10B show SEM images of galvanostatically deposited chromium on GC from the new solution at a cathodic current density of 2.5 A $dm^{-2}$ for 30 minutes and 1 hour, respectively.
Figure 10B:
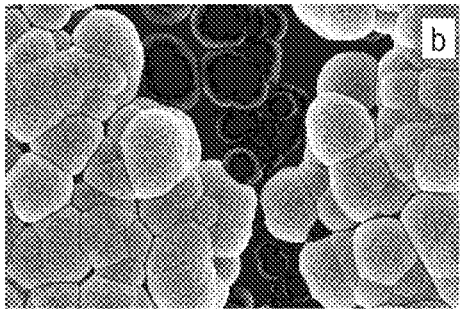

Electrodeposition onto glassy carbon was used for comparing the performance of the new system to the previous measurements. Results of galvanostatic deposition at a cathodic current density of 2.5 A $dm^{-2}$ for 30 minutes and 1 hour are shown in FIGS. 10*a* and 10*b*, respectively. Due to the lower pH range, measurements with a similar current density of 5 A $dm^{-2}$ to the measurements in FIG. 10 were not possible, due to the increased hydrogen evolution. Measurements shorter than 30 minutes yielded very little deposition. In particular, FIG. 10 shows SEM images of galvanostatically deposited chromium on GC from the new solution at a cathodic current density of 2.5 A $dm^{-2}$ for (a) 30 minutes and (b) 1 hour.

A different film structure results from the monomeric complex. Large spherical grains are deposited and the film follows a layer-by-layer growth which can be seen from the underlying layers in the SEM images.

Figure 11A:
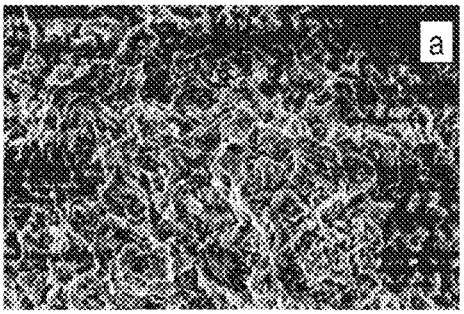
FIGS. 11A to 11D show SEM images of chromium deposited by galvanic pulsing on GC from FIG. 11A, FIG. 11B non-complexed chromium solution with pulse durations of 0.5 s and 0.05 s, respectively FIG. 11C, FIG. 11D new chromium solution with pulse durations of 0.5 s and 0.05 s, respectively.
Figure 11B:
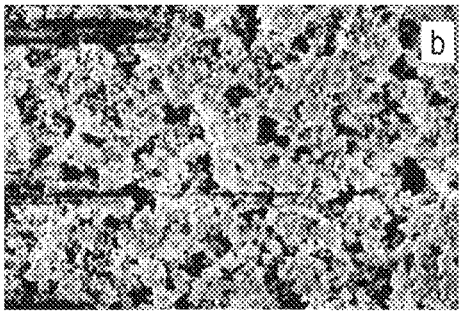
Figure 11C:
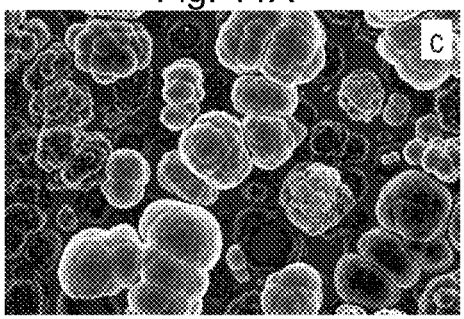
Figure 11D:
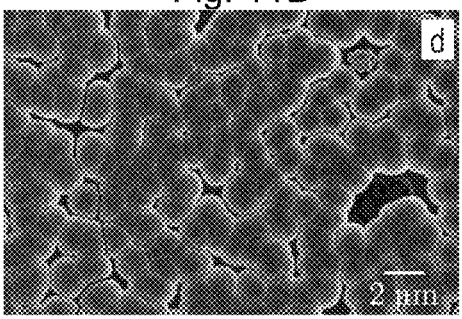

In order to use higher current densities, galvanic pulsing was employed ($I_U$=0 A $dm^{-2}$, $I_L$=−5 A $dm^{-2}$, $t_T$=30 minutes, to $=t_L$=0.5 s). For the same parameters, the measurement was also repeated using pulse durations of 0.05 s. However, in order to have a reference to compare to, these measurements were also done in a solution without malic acid. The SEM images for these measurements without malic acid are shown in FIGS. 11*a* and 11*b*, while those with from the monomeric complex in 11*c* and 11*d*. In particular, FIG. 11 shows SEM images of chromium deposited by galvanic pulsing on GC from (a), (b) non-complexed chromium solution with pulse durations of 0.5 s and 0.05 s, respectively (c), (d) new chromium solution with pulse durations of 0.5 s and 0.05 s, respectively.

Figure 12A:
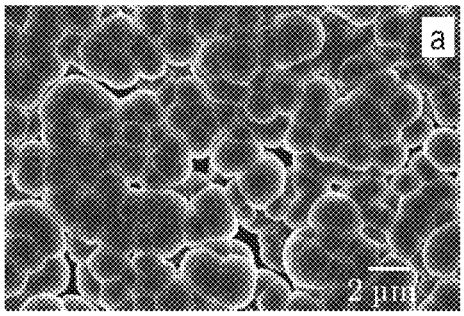
FIGS. 12A and 12B show SEM images of chromium deposited on G using galvanic pulsing using $I_L$=−5 A $dm^{-2}$ and $I_L$=−10 A $dm^{-2}$, respectively.
Figure 12B:
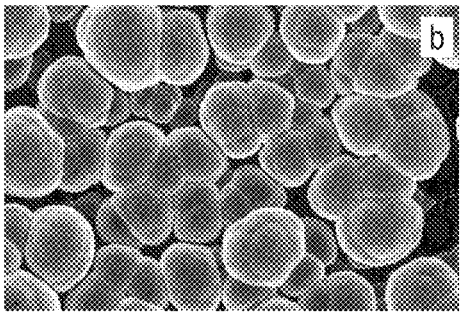

It is clear from the SEM images that the further complexation with malic acid is vital in order to obtain a well structured deposit. In addition, it seems that a pulse duration of 50 ms is ideal for a uniform layer-by-layer growth of the spherical grains. Moreover, the effect of using a more negative pulse ($I_L$=−10 A $dm^{-2}$), on the structure of the deposit was investigated. The results in comparison to a similar measurement to FIG. 11(*d*), are shown in FIG. 12. In particular, FIG. 12 shows SEM images of chromium deposited on G using galvanic pulsing using (a) $I_L$=−5 A $dm^{-2}$ and (b) $I_L$=−10 A $dm^{-2}$.

The images show an increase in particle size, coupled with the increase in cathodic current density. In addition, the particles are less uniform in size and shape than those obtained at −5 A $dm^{-2}$. This indicates a lower degree of progressive nucleation with higher cathodic current densities, since stable nuclei are able to form faster and further reduction of chromium ions occurs preferentially on the pre-deposited nuclei.

Example 4.2, Electrodeposition on Brass

The use of GC electrodes assisted in the development of the new system, since its utilization as a model electrode allowed for investigating the properties of the solution, with as little substrate interference as possible. However, this is rather far from practical application. Hence, initial measurements on metal surfaces have been performed, in order to find out the potential behavior in industrial application.

The common belief in literature and industry is that without the addition of other additives, such as brighteners, whiteners, levelers and wetting agents, very poor or no deposition would occur on metal surfaces. Thus, we have investigated the performance of the newly developed system with none of these additives, even though they might be added.

FIG. 13 shows a Hull Cell measurement conducted on brass, where the current density is varied along the sheet, in order to determine the optimum range for current density for galvanostatic measurements. In particular, FIG. 13 shows SEM images of Hull Cell sample highlighting the microstructure in different current density regions.

From FIG. 13, two observations could be made. First, the structure of the deposit remains the same; in this case, also spherical particles were obtained. In addition, as the current density increases, the size of the particles decreases, and they tend to form a complete, uniform film. Second, the optimum range of current density could be determined to be between 5 and 15 A $dm^{-2}$. Below this range, incomplete films are deposited, and above that, the layers start to crack and are broken off the surface by the action of hydrogen.

Using this information, other sample measurements were carried out on brass, some of which are shown in FIG. 14. In particular, FIG. 14 (*a*), (*b*) show SEM images and galvanic pulsing deposition diagram of Chromium deposited on brass at $I_L$=10 A $dm^{-2}$ and $I_L$=10 A $dm^{-2}$, respectively, FIG. 14 (*c*) SEM image of galvanostatically deposited chromium on brass at j=−10 A $dm^{-2}$ for 10 minutes.

The pulsing measurements in FIGS. 14*a* and 14*b* show a similar behavior to the pulsing measurements carried out on GO, in terms of particle size with respect to $I_L$. However, due to the very large thicknesses deposited, the films would break up, giving a flaky appearance with poor adhesion to the surface.

Galvanostatic deposition, results in a complete film with no addition of additives. While not all the samples of course look identical, however they are quite similar (results not shown).

It has proven that the films also look identical on larger areas and exhibit a high quality. A complete chromium film can be reproducibly deposited without extra additives. In other words, the newly developed system serves as a fundamental building block, which can be modified by additives, depending on the application, to give the desired outcome, like optical properties and thickness requirements. The part geometry also plays a role in determining the optimum operation parameters.

Figure 15A:
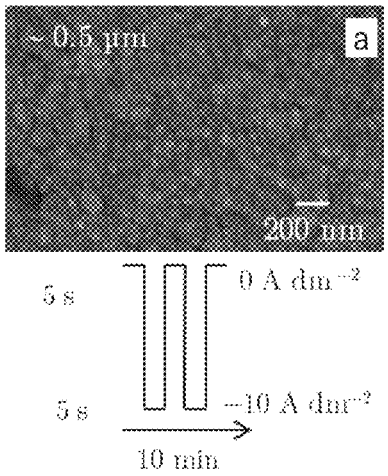
FIGS. 15A to 15C show SEM images and galvanic pulsing diagrams for chromium deposited on brass for a total pulsing duration of 10 minutes, 20 minutes, and 30 minutes, respectively.
Figure 15B:
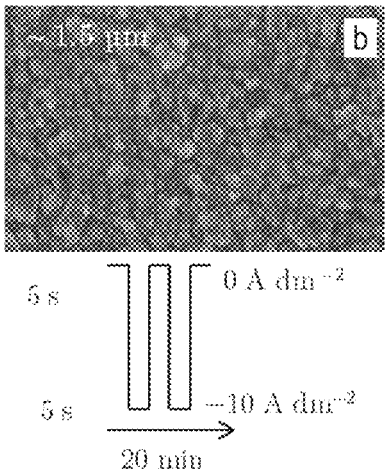

The pulsing schemes were further optimized to yield higher quality deposits, by modifying the pulse duration and total time. These results are shown in FIG. 15. In particular, FIG. 15 shows SEM images and galvanic pulsing diagrams for chromium deposited on brass for a total pulsing duration of (a) 10 minutes (b) 20 minutes and (c) 30 minutes.

Figure 15C:
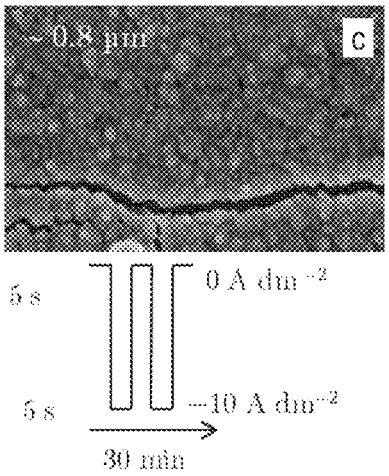
Figure 16A:
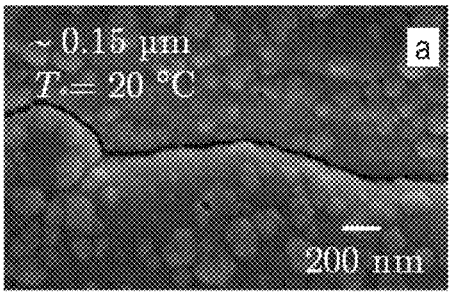
FIGS. 16A to 16D show SEM images of galvanostatically deposited chromium films on brass for 5 minutes with j=−10 A $dm^{-2}$ at temperatures of 20° C., 30° C., 40° C., and 50° C., respectively.
Figure 16B:
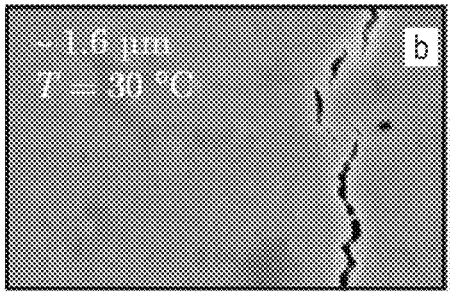
Figure 16C:
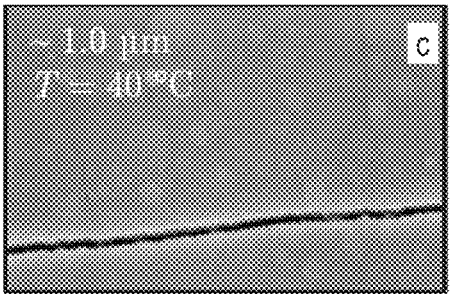
Figure 16D:
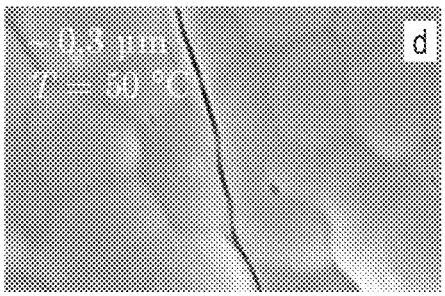

The SEM images in FIG. 15 show that for longer pulse durations the microstructure is more homogeneous. The presence of cracks, like those in FIG. 15*c*, is characteristic of thick chromium layers.

Example 4.3, Thickness and Optical Appearance

A photograph of chromium deposited on an unpolished brass sheet compared to a brass sheet was polished prior to deposition. From the reflection of the camera (not shown), it is evident that in order to have the desired mirror-like finish of chromium, especially for decorative purposes, it is necessary to start with a shiny surface. While it is common practice to pre-deposit a nickel film to further enhance the optical appearance, however it was possible to obtain an almost perfect finish on brass.

The effect of deposition temperature on film thickness and color was also investigated. Film color was assessed by measuring the bluish hue of the reflected light, against a preset value. Here, it was essential to understand the microstructural influence on the color of the reflected light. FIG. 16 shows SEM images of samples deposited at different temperatures, for 5 minutes at j=−10 A $dm^{-2}$. In particular, FIG. 16 shows SEM images of galvanostatically deposited chromium films on brass for 5 minutes with j=−10 A $dm^{-2}$ at temperatures of (a) 20° C., (b) 30° C., (c) 40° C., and (d) 50° C.

The images shown in FIG. 16(*b*) and FIG. 16(*c*) are samples that reflect light with a bluish hue. It can be seen that a very smooth and uniform microstructure assists in obtaining the desired optical finish of chromium. The presence of irregularities in the microstructure diffracts light in an undesired way, resulting in reddish or yellowish films. This trend was also seen in many other samples; all the samples that had a similar microstructure to FIGS. 16(*b*) and (*c*), reflected a bluish color.

Figure 17A:
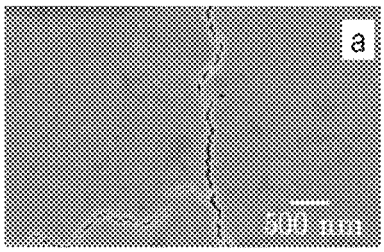
FIGS. 17A and 17B show SEM images highlighting microstructural differences between galvanostatic deposition and pulse plating of chromium on brass, respectively.

Another factor affecting both thickness and optical appearance is the deposition method used. SEM images of a galvanostatically deposited chromium film vs. a film deposited by pulsing are shown in FIG. 17. In particular, FIG. 17 shows SEM images highlighting microstructural differences between (a) galvanostatic deposition and (b) pulse plating of chromium on brass.

Figure 17B:
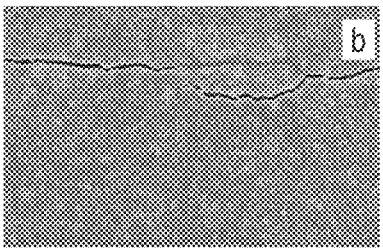

The resulting microstructure from pulse plating is usually a very rough one, like depicted in FIG. 17*b*. This is probably due to the rapid increase in thickness, which prevents a uniform growth of the deposited nuclei to form a homogeneous film.

The relationship between deposition temperature and film thickness, as well as that between deposition technique and film thickness, are plotted in FIG. 18. These values represent the range of thicknesses which are found at different positions on a sample, for many samples. In particular, FIG. 18 (*a*) shows the effect of deposition temperature on thickness (j=−10 A $dm^{-2}$, t=5 min.). FIG. 18 (*b*) shows the relationship between duration and thickness for galvanostatic deposition and galvanic pulse plating. The bars of FIGS. 18 (*a*) and (*b*) with exception of the bars of FIG. 18(*b*) interconnected by a dashed line) refer to galvanostatic deposition (j=10 A $dm^{-2}$). The bars of FIG. 18(*b*) interconnected by a dashed line refer to pulsing ($I_L$=10 A $dm^{-2}$).

Figure 18A:
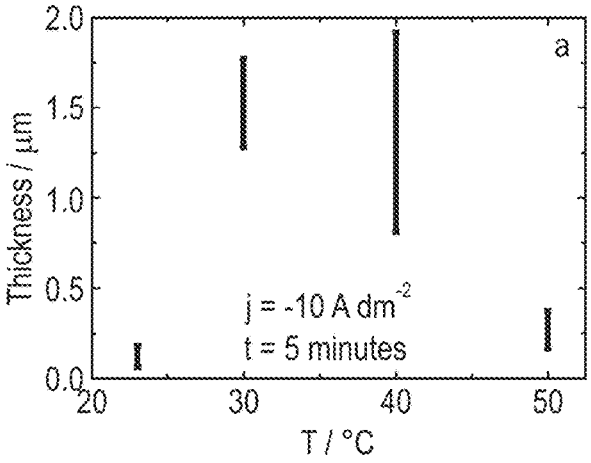
FIG. 18A shows the effect of deposition temperature on thickness and FIG. 18B shows the relationship between duration and thickness, for galvanostatic deposition and galvanic pulse plating.

It can be clearly seen from FIG. 18*a*, that the layer thicknesses suddenly increase with an increase in the deposition temperature to 30° C. Above 40° C., however, the amount of chromium deposited decreases again. It can be observed that the thick layers at 30° C. and 40° C. are very uneven, as evidenced by the greater variability of the measured values. The deposition at 50° C. even provides incomplete coverage in some measurements, although the solution gives good results under comparable conditions at lower temperatures.

The decrease in layer thickness at higher temperatures may be associated with the lower overpotential, resulting from the increase in electrolyte conductivity. If the voltage between the anode and cathode is too low, chromium cannot be reduced to the same extent, leading to thinner films. On the other hand, the removal of an aquo ligand is facilitated at higher temperatures, due to stronger molecular vibrations. As a result, the distance between the chromium ion and cathode surface decreases, and therefore the transfer of electrons proceeds much more efficiently. Hence, if more chromium complexes are under coordinated in this way, deposition becomes efficient. These two opposing processes appear to have a trade off between 30 and 40° C.

Figure 18B:
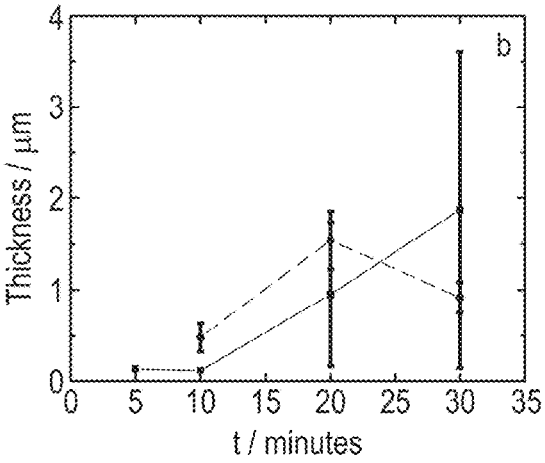

FIG. 18*b* shows the correlation between thickness, time and deposition technique. In the case of pulse plating, rough layers are formed. Due to the high concentration of chromium complexes that flow to the cathode during the off pulse, a greater supply of chromium ions are available in comparison to galvanostatic deposition, which leads to a fast, efficient, but also irregular film growth. The layer thickness is therefore remarkably high even with short plating times. The decrease in the layer thickness after 20 minutes can be caused by the removal of upper metallic chromium layers due to stress effects caused by hydride decomposition.

For galvanostatic deposition, for short times thinner but homogeneous films are deposited. As the time is increased, certain areas of the film grow while others do not, resulting in the very wide thickness range shown in the graph.

Example 4.4, Mechanistic Considerations

As already discussed, the electrolyte is subject to an aging process after the final pH adjustment. Based on the experimental observation that older solutions provide better chromium layers, it was tested whether heating the solution can accelerate this aging. In fact, by heating for a short time, much better results were obtained than would otherwise occur with solutions several days old. The change in the complex was confirmed in the UV-VIS study. It became clear that aging at room temperature over a longer period of time and brief heating of the solution result in a similar change in absorption behavior and thus in the chemical properties of the complex.

After initial attempts to accelerate the aging process by heating at 65° C., it was experimentally determined that heating for two hours at 50° C. is sufficient to then achieve good deposits. After this step, in most cases, formation of chromium hydroxide due to incomplete complexation could no longer be observed.

Further acceleration attempts by heating the solution more intensively were also tested. However, the results deteriorated significantly after heating to higher temperatures. After heating for 1 hour at 100° C., the amount of the deposited chromium was greatly reduced. As suggested earlier, boiling the solution leads to a ligand exchange towards the hexaquo complex. Although this step is thermodynamically inhibited, it is made possible with high temperature. Reduction of chromium from the hexaquo-complex is difficult because of the proximity of the aquo ligands to the chromium center, which reduces the amount of deposited chromium.

Since the absorption behavior remains constant during heating with malic acid at pH 0, it can be concluded that no ligand exchange takes place in this step. Solutions prepared without this heating step behave in the same way as the electrolytes which were heated after addition of the malic acid in further preparation and in deposition. The assumption that this step has no effect on the dominant complex can thus be confirmed.

Based on these spectroscopic findings, and the electrochemical results, the following mechanism in FIG. 19 can be proposed. However, it is not possible to determine whether the reactive complex contains a sulfate species or not. In particular, FIG. 19 shows an illustration for a possible mechanism for chromium deposition from a solution prepared according to the present method.

In contrast to reaction route B, reaction route A does not include the possibility of re-addition of a sulfate or hydrogen sulfate ligand. This re-complexation cannot be ruled out, even if the direct reduction from the malate complex is more likely. In both cases, the reduction is conceivable via both a one-step mechanism, and/or a two-step mechanism, with a divalent chromium complex as an intermediate.

Example 5, Use of Other Complexing Agents

In order to further investigate the newly developed method, identical measurements were performed, with the substitution of malic acid with a weaker alternative, formic acid, and a stronger alternative, oxalic acid. While these systems were not as extensively studied as the malic acid system, the deposition results were sufficient to draw several conclusions.

Example 5.1, Formic Acid

In order to investigate the action of formic acid as a complexing agent, the preparation was carried out identically, with the malic acid substituted by formic acid. Three identical measurements were carried out sequentially, at a current density of 5 A $dm^{-2}$ for 5 minutes. The deposition very quickly deteriorates (results not shown). The third trial out of three trials shows that almost no chromium was deposited. However, for the first measurement, the deposited film was very bright. FIG. 20 shows an SEM image of the first sample (showing less deterioration) of a chromium deposit from a formic acid complexed solution.

The SEM images show a very smooth microstructure, which is in correlation with the very bright film. However, the quick deterioration means the complexing action of the formic acid is not strong enough to maintain a stable complex.

Example 5.2, Oxalic Acid

Similarly, identical solutions were prepared with the malic acid being substituted by oxalic acid. Initially, measurements were also performed at a current density of 5 A $dm^{-2}$ for 5 minutes.

Figure 21A:
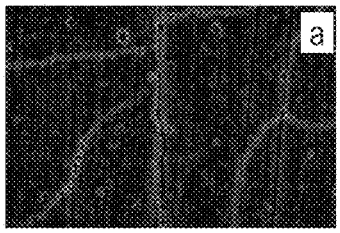
FIGS. 21A to 21C show the SEM images of each sample of galvanostatically deposited chromium films on brass from an oxalic acid complexed solution for 5 minutes with cathodic current densities of 4, 5, and 6 A $dm^{-2}$, respectively.
Figure 21B:
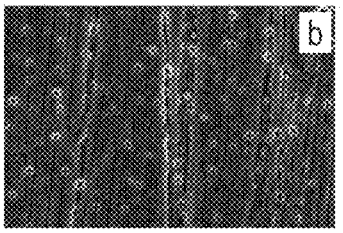
Figure 21C:
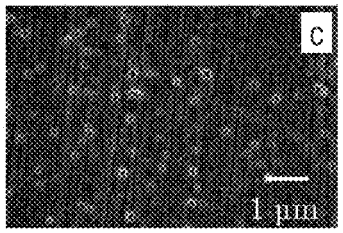

A very high reproducibility of the measurement was obtained (results not shown), due to the stronger complexing action of the oxalic acid. In order to additionally probe the versatility of the oxalic acid system, measurements were also carried out at 4 and 6 A $dm^{-2}$. FIG. 21 shows SEM images of samples performed at 4, 5, and 6 A $dm^{-2}$ for 5 minutes each. In particular, FIG. 21 (*a*), (*b*), (*c*) show the SEM images of each sample of galvanostatically deposited chromium films on brass from an oxalic acid complexed solution for 5 minutes with cathodic current densities of 4, 5, and 6 A $dm^{-2}$, respectively.

Figure 22A:
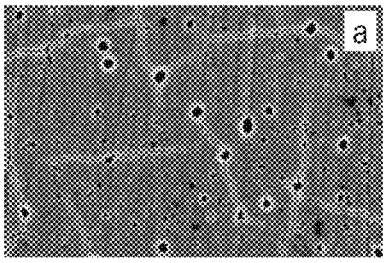
FIGS. 22A and 22B show SEM images for samples of galvanostatically deposited chromium films on brass from an oxalic acid complexed solution with j=−4 A $dm^{-2}$ for 5 and 10 minutes, respectively.
Figure 22B:
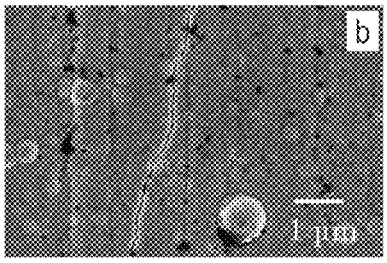

While the films all seemed similar to the eye, the SEM images show that as the current density is increased, the surface irregularity usually also increases. On the other hand the film thickness was almost identical in all samples, which was roughly 0.25 μm. Thus, the next step was to investigate the effect of deposition time on film thickness. Using a current density of 4 A $dm^{-2}$, the deposition was carried out for 5 and 10 minutes. The corresponding SEM images are shown in FIG. 22. In particular, FIGS. 22 (*a*) and (*b*) show SEM images for samples of galvanostatically deposited chromium films on brass from an oxalic acid complexed solution with j=−4 A $dm^{-2}$ for 5 and 10 minutes, respectively.

As the deposition time increases, it is clear that the film becomes more dense, with fewer pores and cracks. In addition, the thickness was doubled from about 0.25 μm to 0.5 μm. Moreover, the oxalic acid system showed a high resilience towards changes in pH. Measurements were conducted at pH values of up to 4 and gave identical deposits.

Hence, it can be clearly seen that the nature of the complexing agent itself plays a vital role in determining the quality of the deposit. Comparing all three complexing agents shows that the higher up the spectrochemical series, the more stable the complex is, and thus, the better the quality of the deposit.

Therefore, what is claimed, is:

1. A method for preparing a Cr(III)-plating solution, comprising or consisting of the steps of:

(a) providing an aged aqueous Cr(III)-solution wherein the aged aqueous Cr(III)-solution is provided by dissolving a Cr(III)-salt in concentrated sulfuric acid, adding water, and heating to a temperature of 70 to 130° C. for at least 1 hour;

(b) adding a polycarbonate or a derivative thereof to the solution of step (a); and (c) adding a borate to the solution of step (b).

2. The method according to claim 1, wherein a pH 2.5 applies for steps (a), (b), and (c).

3. The method according to claim 1, wherein the aged aqueous Cr(III)-solution comprises chromium sulfate or chromium hydroxide sulfate.

4. The method according to claim 1, further comprising after step (b), step (b1) of heating the solution of step (b) to a temperature of 50 to 80° C. for 0.5 to 3.0 hours and/or step (b2) of adjusting a pH of 0.7 to 1.3.

5. The method according to claim 1, further comprising after step (c), step (c1) of heating the solution of step (c) to a temperature of 50 to 80° C. for 0.5 to 3.0 hours and/or step (c2) of adjusting a pH of 1.7 to 2.3.

6. The method according to claim 1, wherein the polycarbonate or the derivative thereof is selected from the group consisting of: dicarbonic acid and tricarbonic acid.

7. The method according to claim 6, wherein the dicarbonic acid is oxalic acid or malic acid.

8. The method according to claim 1, wherein the borate is borax or boric acid.

9. The method according to claim 1, wherein an additive selected from the group consisting of: brightener, whitener, leveler, and a wetting agent is not included.

10. The method according to claim 1, wherein a molar ratio of Cr(III)-ion:polycarbonate or the derivative thereof: borate is 1.0:0.50 to 0.95:2.0 to 9.0.

11. The method according to claim 1, wherein a molar ratio of Cr(III)-ion:polycarbonate or the derivative thereof: borate is 1.0:0.8 to 0.9:5.0 to 6.0.

12. The method according to claim 1, wherein a molar ratio of Cr(III)-ion:polycarbonate or the derivative thereof: borate is 1:0.83 to 0.84:5.33 to 5.34.

* * * * *